US006990705B1

(12) United States Patent
Schouten et al.

(10) Patent No.: US 6,990,705 B1
(45) Date of Patent: Jan. 31, 2006

(54) MULTIFUNCTIONAL CLEANING DEVICE HAVING A COLLAPSIBLE HANDLE

(75) Inventors: Pieter Schouten, Berkeley, CA (US); James R. Kingsbury, Lakewood, CA (US)

(73) Assignee: Carrand Companies, Inc., Compton, CA (US)

( * ) Notice: Subject to any disclaimer, the term of this patent is extended or adjusted under 35 U.S.C. 154(b) by 0 days.

(21) Appl. No.: 10/993,809

(22) Filed: Nov. 20, 2004

(51) Int. Cl.
*A47L 1/06* (2006.01)
*A47L 13/12* (2006.01)

(52) U.S. Cl. ..... 15/111; 15/105; 15/117; 15/121; 15/144.1; 15/144.2; 15/144.4; 15/172; 15/244.2

(58) Field of Classification Search ..... 15/105, 15/111, 114, 117, 121, 144.1, 144.2, 144.3, 15/144.4, 172, 244.2
See application file for complete search history.

(56) References Cited

U.S. PATENT DOCUMENTS

| | | | | |
|---|---|---|---|---|
| 2,280,165 | A * | 4/1942 | Sebastian | 403/94 |
| 3,968,535 | A * | 7/1976 | Nichols, Jr. | 15/105 |
| 3,995,345 | A * | 12/1976 | Larsson | 15/105 |
| 4,281,433 | A * | 8/1981 | Sendoykas | 15/105 |
| 4,302,862 | A * | 12/1981 | Machacek et al. | 15/117 |
| 4,727,986 | A | 3/1988 | Feldstein | |
| 4,742,595 | A | 5/1988 | Isaacs | |
| 5,175,902 | A | 1/1993 | Samuelsson | |
| 5,926,896 | A | 7/1999 | Allemann et al. | |
| 6,088,868 | A | 7/2000 | Cerveny | |
| 6,256,829 | B1 * | 7/2001 | Hatch et al. | 15/144.4 |
| 2002/0088091 | A1 | 7/2002 | Grote et al. | |
| 2002/0162573 | A1 * | 11/2002 | Fernandez | 134/6 |
| 2004/0154117 | A1 | 8/2004 | Patterson | |
| 2004/0177461 | A1 * | 9/2004 | Ajluni | 15/121 |
| 2004/0250365 | A1 * | 12/2004 | Anderson et al. | 15/111 |

* cited by examiner

*Primary Examiner*—Mark Spisich
(74) *Attorney, Agent, or Firm*—George R. McGuire; Bond, Schoeneck & King, PLLC

(57) ABSTRACT

A multifunctional cleaning implement having a collapsible, telescoping handle interconnected to a head assembly. The head assembly includes front and back panels which interlock with or are integrally formed with cleaning implements, such as a squeegee, a brush, a sponge, and/or an ice scraper. The handle is pivotally interconnected by a sliding ball and socket joint to a channel in the head assembly so that it may be collapsed into a stored position within a cavity in the head assembly, or extended from the head assembly and pivoted into an open position perpendicular to the head assembly. A resilient member formed in the channel biases the ball joint to selectively maintain the handle in the open position.

15 Claims, 9 Drawing Sheets

MULTIFUNCTIONAL CLEANING DEVICE HAVING A COLLAPSIBLE HANDLE

BACKGROUND OF THE INVENTION

1. Field of Invention

The present invention relates to cleaning implements and, more specifically, to a multifunctional device having a collapsible handle that permits use of the device as a brush, scraper, squeegee or sponge.

2. Description of Prior Art

Cleaning implements for window have been developed for a variety of tasks. During winter condition, rigid scrapers and snow brushes may be used to clear snow, sleet, and ice from glass surfaces, such as automobile windows. Typically, separate implements for scraping ice and brushing snow are needed as ice scrapers require more control, while snow brushed require length and leverage. Convention attempt to overcome this problem place an ice scraper at one end of an elongated snow brush handle. While a combination device can perform both tasks, the design of the device is not well suited to performing either task as efficiently as separate devices.

In warmer times, squeegees are the preferred cleaning implement for cleaning windows and windshields. Squeegees typically include a flexible member which conforms to a surface and gently removes water that has accumulated and a sponge for scrubbing debris, such as insert remains, that may have adhered to the glass.

During summer months, ice scrapers and snow brushes are unnecessary. Similarly, squeegees are impractical in winter months as they are unable to remove frozen materials. In certain times of the year, climatic conditions may require the use of a scraper on one day and a squeegee the next, if not on the same day. It is therefore necessary for automobile owners to carry an entire arsenal of implements to safely maintain visibility. As a result, the interior of the automobile may become cluttered with various cleaning devices. Even in more moderate climates, automobile owners must swap out winter implements from summer implements when the weather has improved for the long term.

3. Objects and Advantages

It is a principal object and advantage of the present invention to provide a cleaning implement that may be used throughout the year.

It is an additional object and advantage of the present invention to reduce the number of cleaning implements that are needed.

It is a further object and advantage of the present invention to provide an implement can be used for cleaning in close proximity to the use or over extended distances.

Other objects and advantages of the present invention will in part be obvious, and in part appear hereinafter.

SUMMARY OF THE INVENTION

In accordance with the foregoing objects and advantages, the present invention comprises an automobile cleaning device having a collapsible handle interconnected to a head assembly having various cleaning implements attached thereto. The head assembly includes front and back panels which interlock with or are integrally formed with cleaning implements, such as a squeegee, a brush, a sponge, and/or an ice scraper. The handle is pivotally interconnected to a channel in the head assembly so that it may be collapsed into a stored position within in the head assembly, or extended from the head assembly and pivoted into an open position perpendicular to the head assembly.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
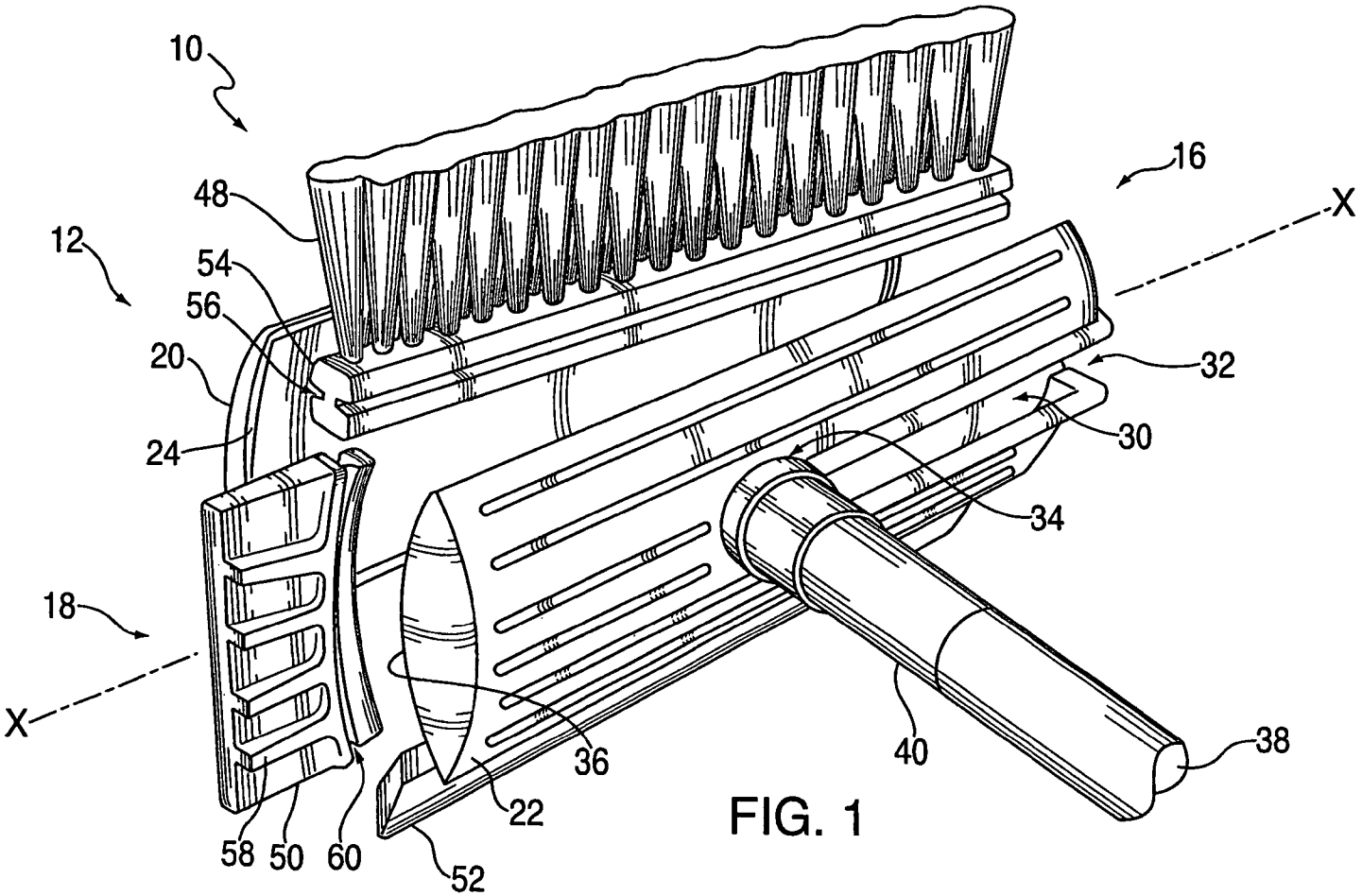
FIG. 1 is an exploded perspective view of a device according to the present invention.

Referring now to the drawings, wherein like numerals refer to like parts throughout, there is seen in FIG. 1 a cleaning device 10 according to the present invention. Device 10 comprises a head assembly 12 that extending longitudinally along axis X-X from a first end 16 to a second end 18. Head assembly 12 includes a front panel 20 and a rear panel 22 that interconnected along their respective edges 24 and 26 and that defines a chamber there between. Rear panel 22 further includes a handle channel 30 formed therein that includes a narrow portion 32 extending along axis X-X from first end 16 to a wide portion 34 in the central region of head assembly 12. Channel 30 communicates with a handle cavity 36 formed within chamber that extends along axis X-X to second end 18 of head assembly.

Device 10 further includes a telescoping handle 38 having a main shaft 40, a ball 42 positioned at one end of shaft 40, and bushing 44 around shaft 40 and abutting ball 40. Ball 42 and bushing 44 are dimensioned to be retained within cavity 36 and wide portion 34 of channel 30. An upper lip 46 formed in wide portion 34 of channel 30 retains ball 42 and bushing 44 within channel 30. Narrow portion 32 of channel is sized to accept handle shaft 40 but not ball 42 and bushing 44. When ball 42 and bushing 44 are positioned in wide portion 34, handle 38 is free to pivot between a closed, stored position where handle shaft 40 extends along axis X-X and is retained in narrow portion 32 of channel 30 and an open, extended position where handle shaft extends outward from head assembly 12 and perpendicularly to axis X-X.

Head assembly 12 further comprises one or more conventional cleaning implements, such as a brush 48, an ice scraper 50, and a squeegee blade 52 that are interconnected to front panel 20 and rear panel 22. Brush 48 includes a base 54 having a brush channel 56 formed therein for engaging front edge 24 and rear edge 26 when front panel 20 and rear panel 22 are interconnected to form head assembly 12.

Scraper 50 having rigid support members 58 may also includes a mounting channel 60 formed therein for engaging front edge 24 and rear edge 26. Squeegee 52 may include a similar means for attachment to head assembly 12.

Figure 2:
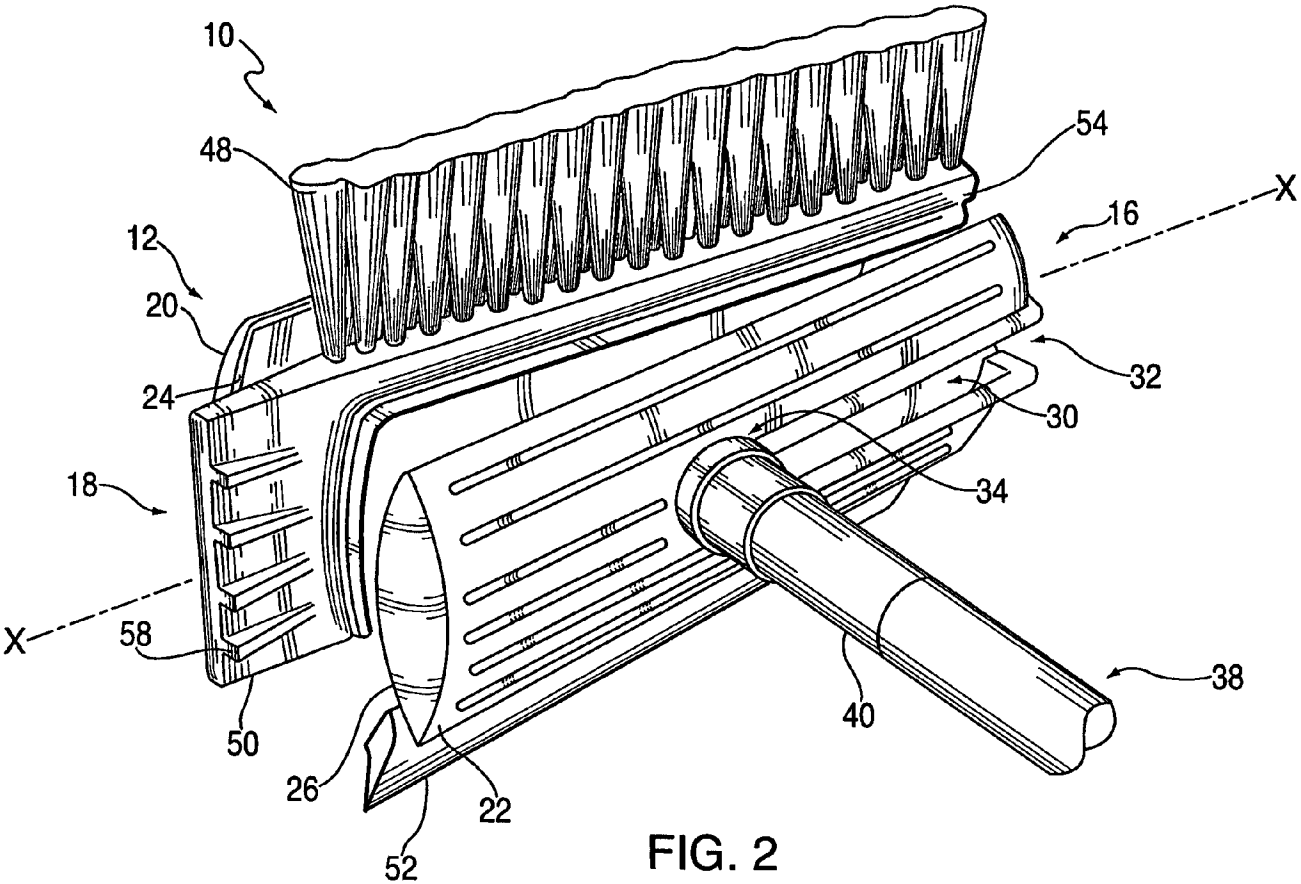
FIG. 2 is an exploded perspective view of an alternative embodiment of the present invention.
Figure 3:
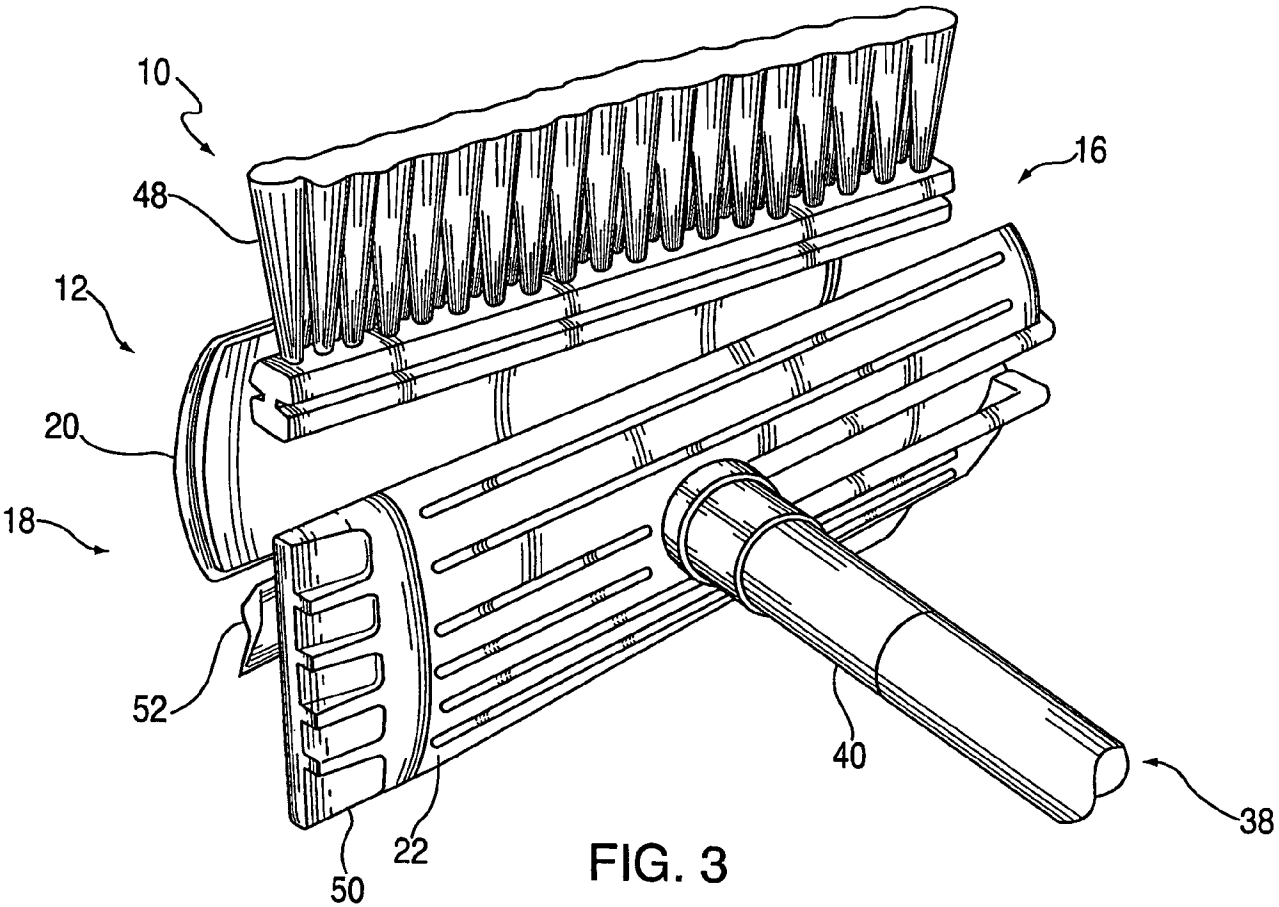
FIG. 3 is an exploded perspective view of another alternative embodiment of the present invention.
Figure 4:
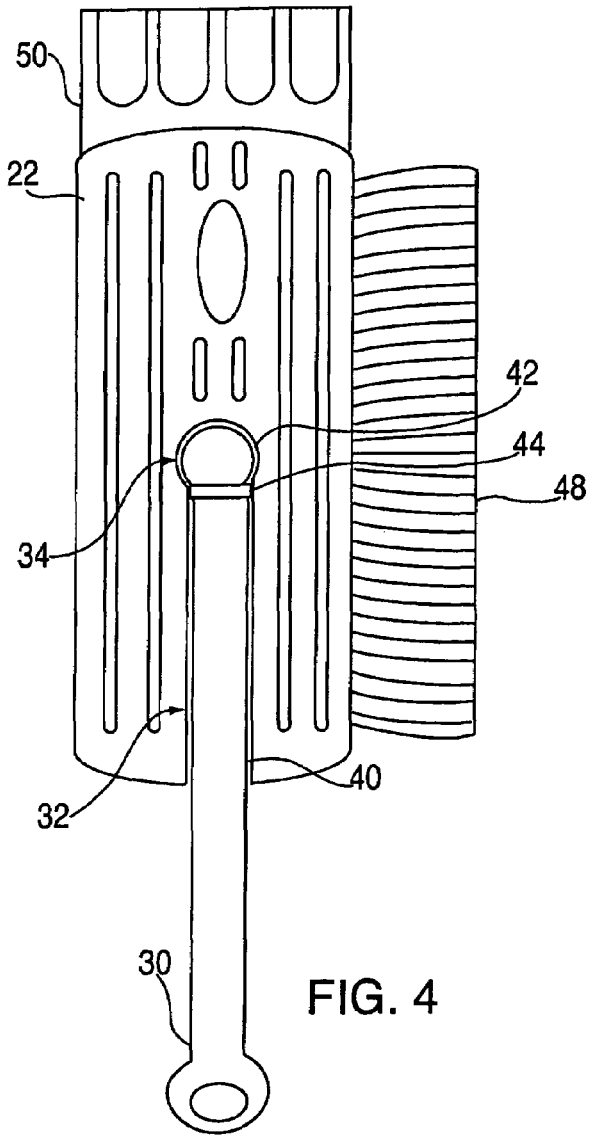
FIG. 4 is a plan view of a device according to the present invention in the collapsed position.
Figure 5:
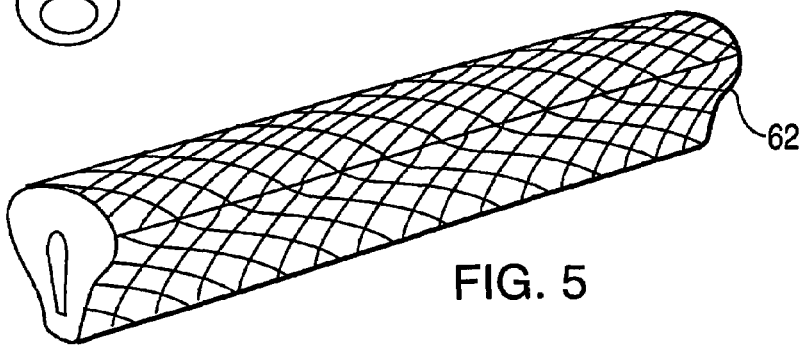
FIG. 5 is a perspective view of a removable implement for a device according to the present invention.

Referring to FIG. 2, in an alternate embodiment of the present invention, brush base 54 and ice scraper 50 may be integrally formed as a single unit for attachment between front panel 20 and rear panel 22. Referring to FIG. 3, another embodiment of the present invention includes ice scraper blade 50 integrally formed with or mounted directly to rear panel 22 of head assembly 12. As seen in FIG. 5, a sponge 62 may be included in lieu of brush 48 or squeegee blade 52.

Figure 6A:
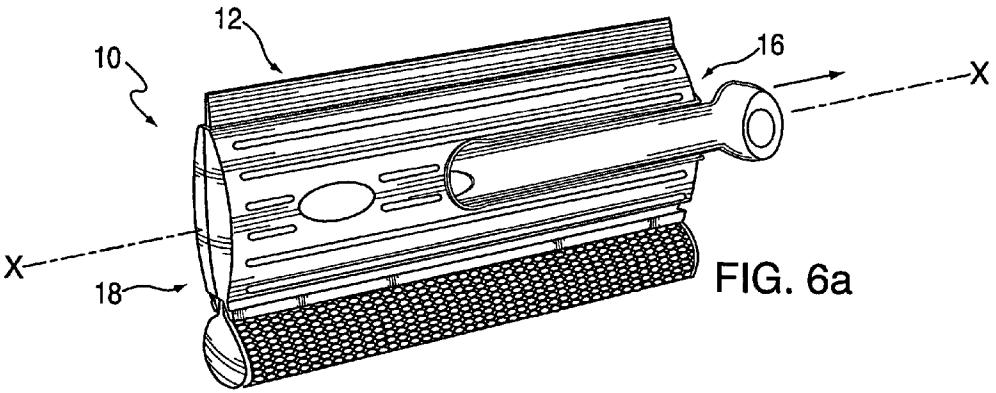
FIGS. 6A–C are perspective views illustrating the conversion of a device according to the present invention between the collapsed and extended positions.
Figure 6B:
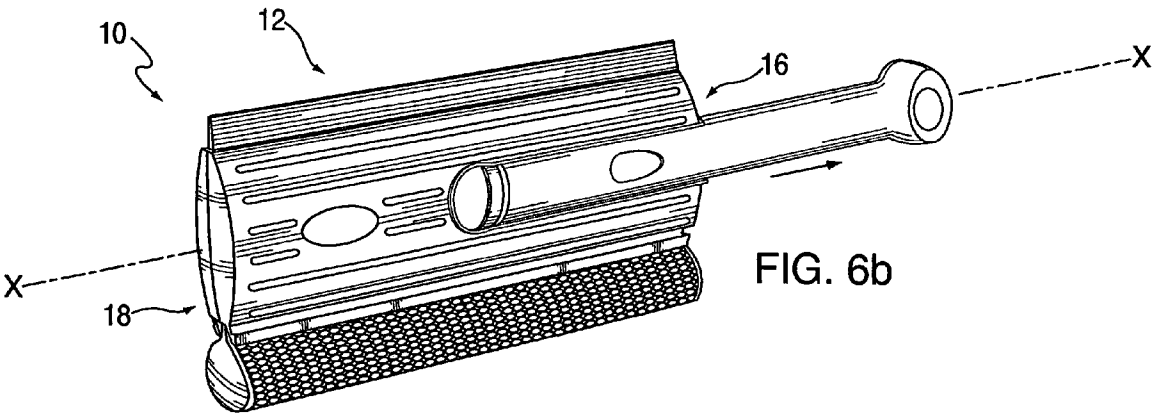
Figure 6C:
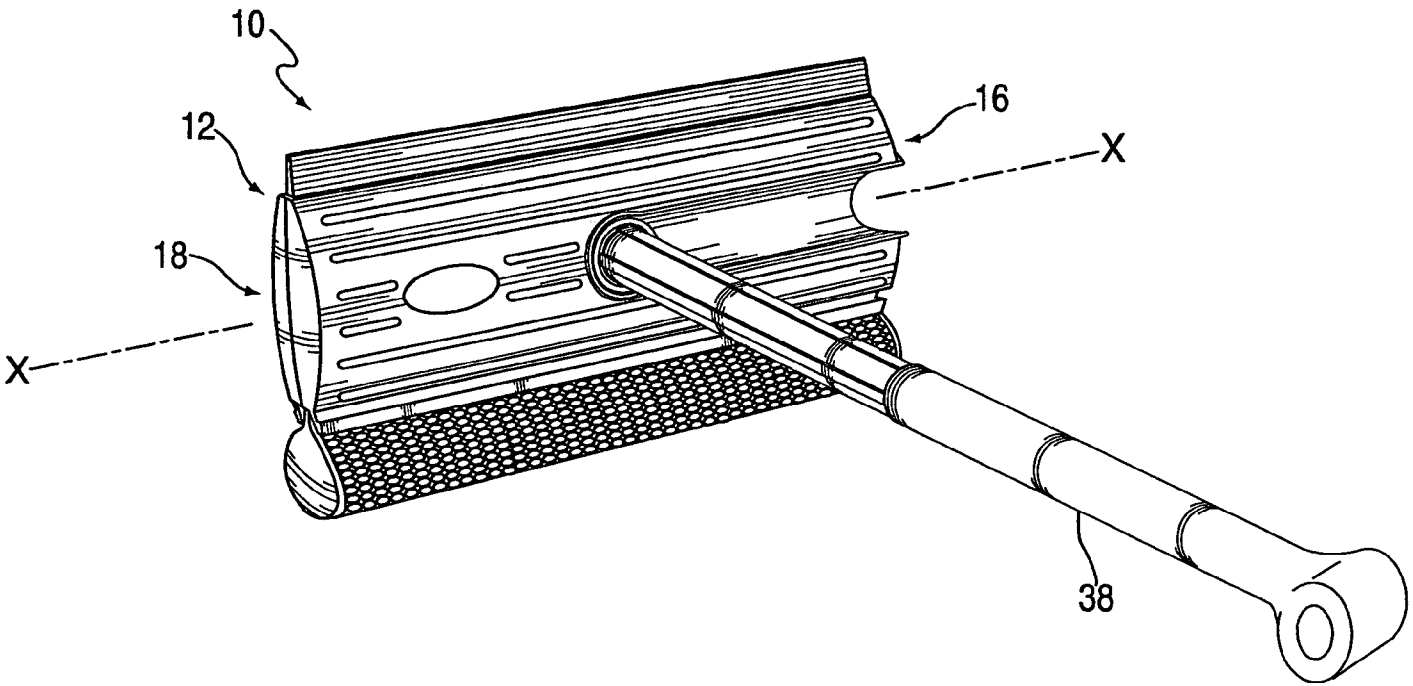

Referring to FIG. 6A, movement of handle 38 between the closed or collapsed position and the open or extended position begins by sliding handle 38 axially along axis X-X toward end 16. When ball 42 and bushing 44 clear cavity 36, they are retained in wide portion 34 of channel 30 by narrow portion 32, as seen in FIG. 6B. Referring to FIG. 6C, handle 38 may pivoted until perpendicular with axis X-X, at which position it is locked, as described hereinafter.

Figure 7A:
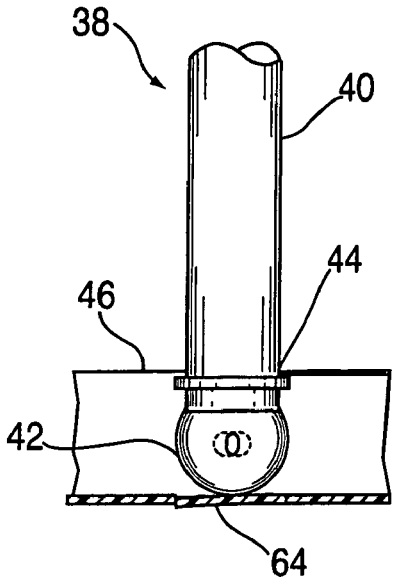
FIGS. 7A–C are cross-sectional views of a feature of the present invention.
Figure 7B:
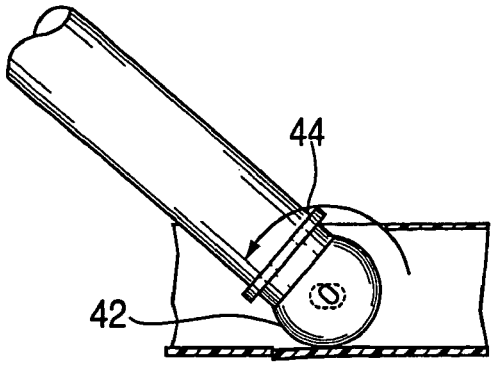
Figure 7C:
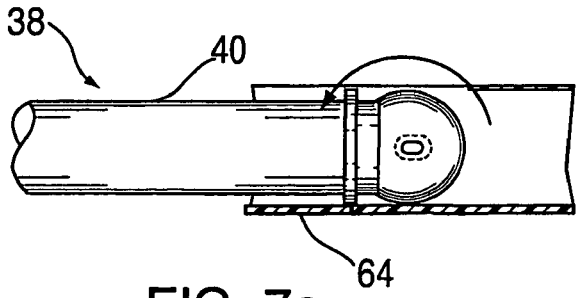
Figure 8:
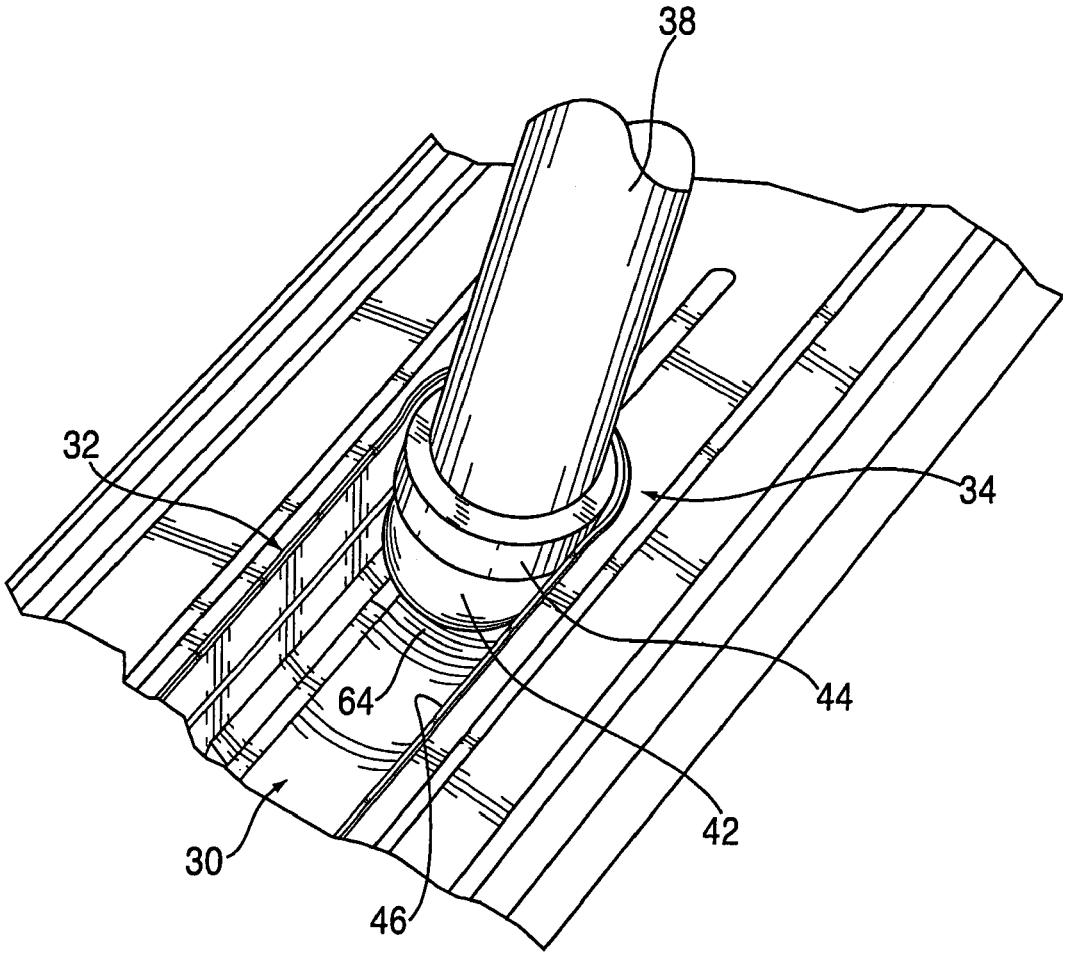
FIG. 8 is a perspective view of a feature of the present invention.

Handle 38 is secured in the open or extended position by a resilient member 64 integrally formed into base of wide portion 34 of channel 30 that biases ball 42 and bushing 44 outwardly from rear panel 22. Referring to FIGS. 7–8, bushing 44 engages upper lip 46 of wide portion 34, and tabs included on opposing sides of ball 42 engage slots formed longitudinally along the inside of channel 30. When resilient member 64 biases ball 42 outwardly, bushing 44 and tabs frictionally retain handle 38 in the open position by engaging upper lip 46 and slots, respectively.

Figure 9A:
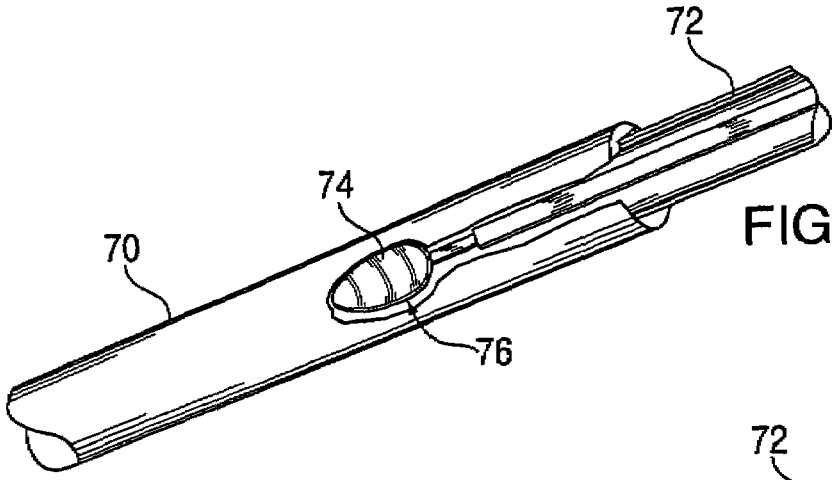
FIGS. 9A–C are perspective views of the operation of a telescoping handle of a device according to the present invention.
Figure 9B:
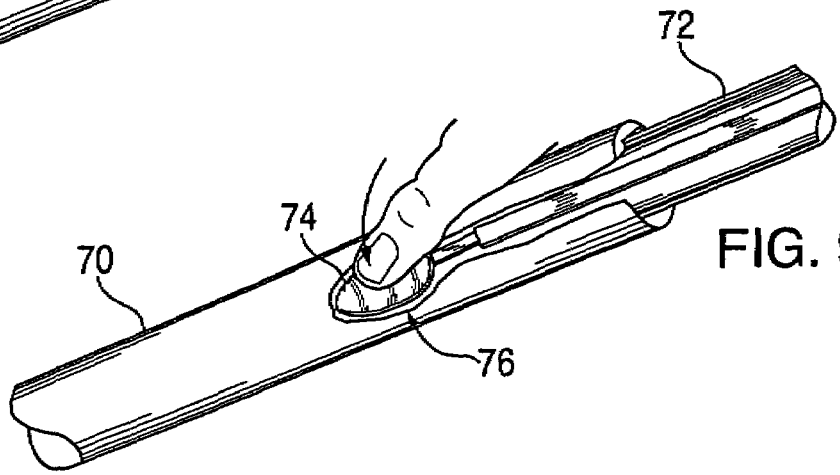
Figure 9C:
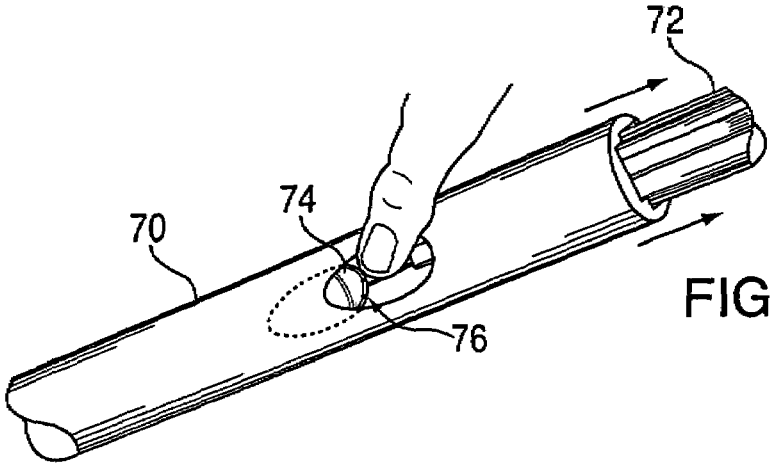

As seen in FIGS. 9A–C, handle 38 may comprise an outer housing 70 and an inner shaft 72 which are telescopically engaged to allow longitudinal extension or retraction of handle 38. An outwardly biased release button 74 may be included on inner shaft 72 to selectively maintain handle 38 in an extended position. When handle 38 is in the fully extended position, and outer housing 70 is fully telescoped over inner shaft 72, button 74 is biased outwardly through a port 76 in outer housing 70, thereby preventing inadvertent retraction or over-extension of handle 38. To retract handle 38, button 74 is depressed inwardly so that it may slide along the inside of outer housing 70, thereby freeing outer housing 70 to telescope over inner shaft 72 and move handle 38 into the retracted position. When handle 38 is re-extended, button 74 slides along the inside of outer housing 70 until it reaches port 76 and is biased outwardly, thereby locking handle 38 in the extended position.

What is claimed is:

1. A cleaning device, comprising:

a head assembly extending along an axis and including a cavity and a channel in communication with said cavity formed therein;

a handle interconnected to said head assembly, wherein said handle is selectively moveable between a first, stored position where said handle extends parallel to said axis, and a second, extended position where said handle extends perpendicularly to said axis, said handle including a shaft having first and second ends and a ball attached to said first end of said shaft; and said channel including a wide portion adjacent to said cavity and a narrow portion extending from said wide portion to the peripheral edge of said head assembly, wherein said wide portion of said channel includes a lip for engaging and retaining said ball in said wide portion of said channel and a resilient member formed therein for biasing said ball toward said lip when said handle is in the extended position.

2. The device of claim 1, wherein said handle is stored within said cavity and said channel when it is said first, stored position.

3. The device of claim 1, wherein said ball is adapted for positioning within said cavity when said handle is in the first position and within said wide portion of said channel when said handle is in the second position.

4. The device of claim 1, wherein said handle further includes an outer housing telescopically engaged with an inner member.

5. The device of claim 4, further comprising a brush, a scraper, and a squeegee blade interconnected to said head assembly.

6. The device of claim 4, further comprising a sponge, a scraper, and a squeegee blade interconnected to said head assembly.

7. The device of claim 5, wherein said scraper and said brush are integrally formed together.

8. The device of claim 5, wherein said scraper is integrally formed into said head assembly.

9. The device of claim 4, further comprising at least one tab on said ball engaging at least one corresponding slot formed into said wide portion of said channel and said cavity.

10. The device of claim 9, wherein said resilient member biases said at least one tab against said at least one slot when said handle is in the second position.

11. The device of claim 9, wherein said tab is elongated along a second axis that is parallel to said axis of said head assembly when said handle is in the first position and perpendicular to said axis of said head assembly when said handle is in the second position.

12. The device of claim 9, wherein said slot permits said tab to slide when said handle is in the first position and resists movement of said tab when said handle is in the second position.

13. A cleaning device, comprising:

a head assembly having an elongated body extending along a first axis, first and second opposing minor edges, and first and second opposing major edges;

a cavity having an open end formed in said body of said head assembly and extending within said head assembly along said first axis to a point proximate to said first minor edge;

a channel formed in said body of said head assembly and communicating with said open end of said cavity, wherein said channel includes a wide portion adjacent said open end of said cavity and a narrow portion which extends from said wide portion along said first axis through said second minor edge of said head assembly;

a handle having a first end and a second end, wherein said handle is sized for releasable accommodation in said narrow portion of said channel;

a ball pivotally interconnecting said handle and said head assembly, wherein said ball is slidingly engaged with said cavity and said wide portion of said channel for movement from a position proximate to said first minor edge to said wide portion of said channel and for pivot movement when positioned in said wide portion of said channel; and a resilient member positioned in said wide portion of said channel for biasing said ball outwardly from said head assembly.

14. The device of claim 13, wherein said wide portion of said channel includes a lip for retaining said ball.

15. The device of claim 13, wherein said ball further includes at least one elongated tab.

* * * * *